US006716490B2

(12) United States Patent
Hayashi et al.

(10) Patent No.: US 6,716,490 B2
(45) Date of Patent: Apr. 6, 2004

(54) METHOD FOR MAKING ENAMELED STEEL SHEET

(75) Inventors: Kazuhiro Hayashi, Narashino (JP); Masao Taguchi, Narashino (JP); Yasumasa Fukushima, Chiba (JP); Masato Takagi, Chiba (JP); Shinichi Noma, Koshigaya (JP)

(73) Assignee: Kawasaki Steel Metal Products & Engineering Inc. (JP)

( * ) Notice: Subject to any disclaimer, the term of this patent is extended or adjusted under 35 U.S.C. 154(b) by 13 days.

(21) Appl. No.: 10/347,981

(22) Filed: Jan. 21, 2003

(65) Prior Publication Data

US 2003/0194498 A1 Oct. 16, 2003

(30) Foreign Application Priority Data

Jan. 30, 2002 (JP) ..... 2002-021268

Jan. 30, 2002 (JP) ..... 2002-021553

(51) Int. Cl.[7] ..... B01J 19/08

(52) U.S. Cl. ..... 427/560; 427/346; 427/376.1; 427/424; 427/427; 427/600

(58) Field of Search ..... 427/346, 376.1, 427/424, 427, 600

*Primary Examiner*—Bernard Pianalto
(74) *Attorney, Agent, or Firm*—Piper Rudnick LLP

(57) ABSTRACT

A method for making an enameled steel sheet includes the steps of spraying a slurry to form a slurry layer onto a surface of a substrate and firing the slurry layer. In this method, the slurry has a static surface tension of 50 dyne/cm or less and an apparent viscosity of 500 mPa·s that is measured with a model E viscometer at a rotation of 100 rpm. Alternatively, the method includes a step of spraying a slurry for forming an enamel layer onto a surface of a substrate, wherein the substrate is vibrated when the slurry is applied or when the slurry applied is still fluid.

5 Claims, No Drawings

METHOD FOR MAKING ENAMELED STEEL SHEET

BACKGROUND OF THE INVENTION

1. Field of the Invention

The present invention relates to a method for making an enameled steel sheet. In particular, the present invention relates to a method for making an enameled steel sheet having a flat (smooth) surface that is suitable for marker boards, black boards, tunnel interior materials, building interior and exterior boards, and the like.

2. Description of the Related Art

Enameled steel sheets having enamel layers on their surfaces exhibit high corrosion resistance, enhanced chemical resistance, high weathering resistance, and striking appearance and have prolonged life. The enameled steel sheets are superior to coated steel sheets in hardness, weathering resistance, efficiency of washing, heat resistance, and inflammability. On the other hand, a disadvantage of the enameled steel sheets is formation of surface irregularity, which looks like the skin of an orange and is called "orange peel". Surface flatness is particularly essential for enameled steel sheets for marker boards. "Orange peel" would devalue sales functions of the enameled steel sheets.

In general, a process for making enameled steel sheets includes the steps of coating enamel slurry (hereinafter merely referred to as slurry) on a surface of a base sheet and firing the sheet to form an enamel layer on the sheet. It is believed that one reason for the formation of "orange peel" is coating of the slurry by spraying or the like, although its mechanism is still unclear. Since droplets formed on the surface of the steel sheet by spraying are deposited as it is on the surface, the surface after the spraying of the slurry also has irregularity. This irregularity would probably remains as "orange peel" after firing.

A possible solution not for forming "orange peel" is use of a roll coater or a knife coater that can form a coating layer with a flat surface. Unfortunately, coating with a coater, which involves high operation cost, is unsuitable for manufacturing of enameled products. Furthermore, slurry used in a coater process should have higher viscosity than slurry used in a spraying process; hence, a large quantity of organic thickener such as carboxymethylcellulose (CMC) should be compounded to increase the viscosity. However, such an organic thickener results in deterioration of enamel characteristics of the fired product, such as blackish enamel color and increased bubble defects in the enamel layer.

SUMMARY OF THE INVENTION

An object of the present invention is to provide a method for making an enameled steel sheet that has a flat surface without "orange peel", and is superior in enamel characteristics such as hardness, weathering resistance, efficiency of washing, heat resistance, inflammability, corrosion resistance, chemical resistance, and appearance, at low cost.

The inventors have discovered that an enameled steel sheet with a flat surface is not obtainable unless the surface of the substrate coated with slurry is flat. The inventors have also discovered that a slurry having a low static surface tension is effective for formation of a flat slurry layer at an initial stage of coating because of enhanced wettability of the slurry to the substrate. Furthermore, the inventors have discovered that a low-viscosity slurry has enhanced wettability to the substrate and thus readily forms a flat slurry layer by coating.

According to a first aspect of the present invention, a method for making an enameled steel sheet includes the steps of spraying a slurry to form a slurry layer onto a surface of a substrate and firing the slurry layer, wherein the slurry has a static surface tension of 50 dyne/cm or less and an apparent viscosity of 500 mPa·s that is measured with a model E viscometer at a rotation of 100 rpm. The slurry may contain a surfactant for controlling the static surface tension. Preferably, the slurry has a specific gravity of at least 1.3.

As a result of further investigation, the present inventors have discovered that the surface unevenness or irregularity of the slurry layer coated on the substrate can be removed by vibration of the substrate when the slurry is applied or when the slurry is still fluid and that the fired substrate also has a significantly flat enamel surface.

According to a second aspect of the present invention, a method for making an enameled steel sheet includes a step of spraying a slurry for forming an enamel layer onto a surface of a substrate, wherein the substrate is vibrated when the slurry is applied or when the slurry applied is still fluid. Preferably, the substrate is vibrated by an acceleration of vibration of at least 1 G wherein G is gravitational constant.

DESCRIPTION OF THE PREFERRED EMBODIMENTS

The method according to the present invention will now be described in detail. In the specification, "the method" indicates one that is common to both the first and second aspects, unless otherwise specifically stated.

The method for making an enameled steel sheet according to the present invention includes coating slurry on a surface of a substrate and firing the coating layer to form an enamel layer.

In the present invention, the substrate may be composed of any material. Examples of the substrate include plain steel sheets such as SPP, SPCC, SPHC, and SS; stainless steel sheets such as ferritic stainless steel sheets (SUS430 series) and austenitic stainless steel sheets (SUS304 series); metal sheets such as ferritic heat resisting steel sheets (SUH409 series) and aluminum sheets; galvanized steel sheets such as aluminum-plated steel sheets, aluminum/zinc-plated steel sheets, and zinc/iron-plated steel sheets; and enameled sheets thereof. Herein, SPP, SPCC, SPHC, and SS, SUS430, SUS304, and SUH409 are referred to in Japanese Industrial Standard (JIS) G3133, G3141, G3131, G3101, G4304, G4305 and G4312.

Pretreatment for the substrate is not necessarily required. However, degreasing treatment is effective in improvement in wettability of slurry. The substrate may be subjected to any surface treatment such as plating for improving the adhesiveness between the steel sheet of the substrate and the enamel layer. Examples of surface treatment include chromating, phosphating, plating with nickel, cobalt, molybdenum, or manganese, and alkaline etching. For improving adhesiveness between the steel sheet substrate and the enamel layer, nickel plating or alkaline etching is particularly effective in acceleration of reaction of the steel sheet substrate with the enamel layer.

The slurry coated on the surface of the substrate may be prepared by any conventional process. The slurry is generally prepared as follows: Frit (powder) composed of feldspar, soda ash, boric acid, and silica sand, color pigments such as titanium oxide, zinc oxide, iron oxide, and cobalt oxide, additives for improving dispersibility such as clay, potassium chloride, and nitrate salts are compounded with a dispersion medium such as water and are pulverized in, for example, a ball mill.

In the present invention, the slurry is preferably applied to the substrate by a spraying process in view of workability and process cost. Among spraying processes that are preferably used are a plain spraying process and a rotary spraying process. As in an electrostatic coating process, an electrostatic voltage may be applied to the slurry during the spraying process, the substrate being grounded, so that the substrate attracts a larger amount of slurry by electrostatic force. This process improves the utilization rate. In the spraying process, the spraying pressure is preferably in the range of 0.1 MPa to less than 1.0 MPa.

Independent portions of the first aspect and the second aspect according to the present invention will now be described. In the first aspect, the slurry preferably has a static surface tension of 50 dyne/cm or less and more preferably 35 dyne/cm or less. Such slurry enhances wettability to the substrate, forms a flat surface at an initial coating state, and thus form a flat enamel surface. A static surface tension exceeding 50 dyne/cm impairs wettability, resulting in many separated droplets on the surface. That is, the surface has irregularity at a wet state.

In order to reduce the static surface tension of the slurry to 50 dyne/cm or less, a surfactant may be added. The surfactant can maintain low surface tension with a slight change for a long period.

The surfactant may be of any type, for example, an anionic type, a cationic type, an ampholytic type, or a nonionic type. The surfactant is preferably added in an amount of 0.01 parts by weight or more and more preferably 0.1 parts by weight on the basis of 100 parts by weight of the sum of liquid and solid components in the slurry. Since the surfactant is generally an organic substance, addition of a large amount of surfactant results in formation of a blackish enamel color. Thus, the upper limit of the surfactant content is preferably 10 parts by weight.

The apparent viscosity (hereinafter referred to as merely viscosity) of the slurry is measured with a model E viscometer, which is a cone plate rotary viscometer. The viscosity of the slurry is adjusted to 500 mPa·s or less and preferably 100 mPa·s or less wherein the viscosity is measured at a rotation of a conical rotor of 100 rpm.

In general, the viscosity of the slurry is controlled by addition of inorganic substances such as clay, silica, and nitrite salts. In the present invention, the viscosity may be controlled by addition of water. An excess amount of water, however, decreases the specific gravity of the slurry. A low specific gravity of the slurry causes solid-liquid separation that may form defects such as "water line" and "tearing" on the enameled surface. To prevent the formation of such defects for use of water, the specific gravity of the slurry is preferably controlled to at least 1.3.

The substrate with coated slurry is fired to form an enamel layer on the surface of the substrate. The firing temperature is preferably in the range of 650° C. to 950° C. and more preferably 700° C. to 850° C., and the firing time is preferably in the range of 0.5 minutes to 30 minutes. When the substrate is fired, the substrate does not need to be completely dried: in other words, the slurry may contain water.

In the first aspect, coating of the slurry and firing of the substrate may be performed one time or may be repeated several times. For example, undercoating slurry is applied on a surface of a substrate, followed by firing for forming an undercoating enamel layer, and then finishing slurry is applied on the undercoating enamel layer, followed by firing for forming a finishing enamel layer. In this process, a double enamel layer is formed. In the double enamel layer, the undercoating enamel layer and the finishing enamel layer may be composed of the same enamel component or different enamel components.

The method according to the first aspect of the present invention is also applicable to coating of slurry to a nonmetal substrate for forming an enamel product, in addition to coating to the metal substrate for forming the enameled steel sheet.

The method according to the second aspect of the present invention will now be described. In the method according to the second aspect, nonaqueous slurry containing an organic solvent may also be used, in addition to the aqueous slurry.

In the method according to the second aspect, the substrate is vibrated when the slurry is applied or when the slurry applied is still fluid. Vibration planarizes the uneven surface of the wet slurry, and thus forms an enamel layer with a flat surface. Preferably, the vibration applied to the substrate has an acceleration of vibration of 1 G or more and more preferably 2.5 G or more in consideration of workability.

The vibration may be generated by various mechanisms, i.e., a mechanical system using a cam or imbalanced plumb, an electrohydraulic actuator vibrated by hydraulic pressure, an electrokinetic system by Fleming's law, a ferroacoustic system using sound, and a magnetic system by magnetic force. Among these, the mechanical system, which is compact and inexpensive, is preferred.

The firing temperature is preferably in the range of 650° C. to 950° C. and more preferably 700° C. to 850° C., and the firing time is preferably in the range of 0.5 minutes to 30 minutes. When the substrate is fired, the substrate need not be completely dried, in other words, the slurry may contain water. For use of aqueous slurry, a drying step at 100° C. or more may be employed between the coating step and the drying step. The drying step does not affect the properties and appearance of the enamel layer.

In the method according to the second aspect, the coating of the slurry to the substrate and the vibration of the substrate may be performed one time or may be repeated several times. For example, undercoating slurry is applied on a surface of a substrate, followed by vibration and firing for forming an undercoating enamel layer, and then finishing slurry is applied on the undercoating enamel layer, followed by vibration and firing for forming a finishing enamel layer. In this process, a double enamel layer is formed. In the double enamel layer, the undercoating enamel layer and the finishing enamel layer may be composed of the same enamel component or different enamel components.

In the present invention, the method according to the first aspect and the method according to the second aspect may be employed in combination.

EXAMPLES

EXAMPLES according to the present invention and COMPARATIVE EXAMPLES will now be described.

Examples 1 to 8 According to First Aspect

A nickel-plated steel sheet composed of a 0.6-mm thick plain steel sheet of which the two faces were coated with nickel plating layers having a total plating density of 100 mg/m$^2$ for the two layers was subjected to degreasing treatment and alkaline etching treatment.

An undercoating slurry having a composition shown in Table 1 was sprayed onto the nickel-plated steel sheet to form a wet film with a thickness of about 50 μm, and was fired at 810° C. for 2 minutes in an electric oven to prepare an undercoating enamel steel sheet.

A surfactant (Surfynol 465 made by Nissin Chemical Industry Co., Ltd.) as shown in Table 3 and water for controlling the specific gravity were added to finishing slurries having compositions shown in Table 2 to prepare coating slurries having static surface tensions and apparent viscosities shown in Table 3. Each coating slurry was sprayed onto the undercoating enamel steel sheet to form a wet layer with a thickness of about 120 μm.

Comparative Examples 1 to 3 for First Aspect

A surfactant as shown in Table 3 and water for controlling the specific gravity were added to finishing slurries having compositions shown in Table 2 to prepare coating slurries having static surface tensions and apparent viscosities shown in Table 3. Each coating slurry was sprayed onto the undercoating enamel steel sheet to form a wet layer with a thickness of about 120 μm.

The static surface tension in each of EXAMPLES 1 to 8 and COMPARATIVE EXAMPLES 1 to 3 was measured with a CBVP surface tensiometer A3-SOL made by Kyowa Interface Science Co., Ltd. The apparent viscosity was measured with a model E viscometer VISCONIC ED made by Tokyo Keiki at a rotation of 100 rpm.

Each enamel steel sheet coated with finishing slurry was fired at 790° C. for 2 minutes in an electric oven to prepare a finishing enamel steel sheet.

The flatness of the finishing enamel steel sheet was evaluated by a Wd value that was measured with a Wave-Scan DOI (orange peel measurement unit) made by BYK Gardner. A lower Wd value indicates a higher flatness. The results are shown in Table 3.

Examples 9 to 14 According to Second Aspect

Preparation of Undercoating Enamel Steel Sheets

Ten nickel-plated steel sheets were subjected to degreasing and alkaline etching treatment, wherein each steel sheet was a plain steel sheet KTM for enameling, had a thickness of 0.6 mm made by Kawasaki Steel Corporation, and had plated nickel layers with a total plating density of 100 mg/m$^2$ on the two sides.

An undercoating slurry having a composition shown in Table 1 was sprayed onto each nickel-plated steel sheet and was fired at 810° C. for 2 minutes in an electric oven to prepare an undercoating enamel steel sheet having an underling enamel layer with a thickness of 20 μm.

A finishing slurry having a composition shown in Table 2 was prepared. The finishing slurry was sprayed onto the undercoating enamel steel sheet to form a finishing slurry layer with a coating density of about 150 ml/m$^2$. Immediately after the coating, the substrate was vibrated at an acceleration of vibration for a time shown in Table 3, and the coating layer was dried at 105° C. for 10 minutes.

The acceleration of vibration was measured with a handy vibrometer AHV-11 made by Akashi Corporation in which the vibrometer was brought into contact with the uncoated surface.

Comparative Example 4 for Second Aspect

A slurry having a composition shown in Table 2 was sprayed onto the undercoating enamel steel sheet to form a finishing slurry layer with a coating density of about 150 ml/m$^2$. After an elapsed time of at least 60 seconds, the coating layer was dried at 105° C. for 10 minutes.

The steel sheets with finish slurry layers according to EXAMPLES 9 to 14 and COMPARATIVE EXAMPLE 4 were fired at 790° C. for 2 minutes in an electric oven to prepare finishing enamel steel sheets.

The flatness of each finishing enamel steel sheet was evaluated with the Wd value. The results are shown in Table 4.

TABLE 1

| Type of slurry | Undercoating frit made by Ferro Enamels Limited | Clay 11 | Silica | Borax | F-10 | Magnesium Carbonate | Water |
|---|---|---|---|---|---|---|---|
| Undercoating slurry | 100 | 4 | 15 | 0.3 | 2 | 0.2 | 72 |

TABLE 2

| Type of slurry | Highly opaque frit made of Ferro Enamels Limited | Clay 11 | FR-22 | P-024 | P-062 | kcl | Water |
|---|---|---|---|---|---|---|---|
| Finishing slurry | 100 | 5 | 1.8 | 0.2 | 0.4 | 0.2 | 54 |

TABLE 3

| | Surfactant (for 100 parts of slurry) | specif-ic gravity | static surface tension | Apparent viscosity | wd value | Enamel surface flatness |
|---|---|---|---|---|---|---|
| Example 1 | 0.01 | 1.5 | 38 | 300 | 12 | Satisfactory |
| Example 2 | 0.1 | 1.5 | 30 | 300 | 12 | Satisfactory |
| Example 3 | 0.5 | 1.5 | 28 | 300 | 12 | Satisfactory |
| Example 4 | 10 | 1.5 | 28 | 300 | 12 | Satisfactory |
| Example 5 | 12.5 | 1.5 | 28 | 300 | 12 | satisfactory |
| Example 6 | 0.5 | 1.4 | 28 | 100 | 10 | Satisfactory |
| Example 7 | 0.5 | 1.3 | 28 | 50 | 10 | Satisfactory |
| Example 8 | 0.5 | 1.6 | 28 | 450 | 18 | Satisfactory |
| Comparative Example 1 | 0.5 | 1.2 | 28 | 10 | 10 | Sagging |
| Comparative Example 2 | 0 | 1.5 | 70 | 300 | 30 | Orange peel |
| Comparative Example 3 | 0.5 | 1.7 | 28 | 750 | 27 | Orange peel |

TABLE 4

| | Vibration | Acceleration of vibration G:Gravitational constant | Vibra-tion time (sec.) | wd value | Enamel surface flatness |
|---|---|---|---|---|---|
| Example 9 | Vibrated | 0.5 G | 60 | 18 | Satis-factory |
| Example 10 | Vibrated | 1.0 G | 60 | 13 | Satis-factory |
| Example 11 | Vibrated | 2.5 G | 10 | 10 | Satis-factory |
| Example 12 | Vibrated | 4.0 G | 5 | 10 | Satis-factory |
| Example 13 | Vibrated | 5.0 G | 2 | 10 | Satis-factory |
| Example 14 | Vibrated | 7.5 G | 1 | 10 | Satis-factory |
| Comparative Example 4 | Not vibrated | — | — | 30 | Orange peel |

What is claimed is:

1. A method for making an enameled steel sheet comprising the steps of spraying a slurry to form a slurry layer onto a surface of a substrate and firing the slurry layer, wherein the slurry has a static surface tension of 50 dyne/cm or less and an apparent viscosity of 500 mPa·s that is measured with a model E viscometer at a rotation of 100 rpm.

2. The method according to claim 1, wherein the slurry contains a surfactant for controlling the static surface tension.

3. The method according to either claim 1 or 2, wherein the slurry has a specific gravity of at least 1.3.

4. A method for making an enameled steel sheet comprising a step of spraying a slurry for forming an enamel layer onto a surface of a substrate, wherein the substrate is vibrated when the slurry is applied or when the slurry applied is still fluid.

5. The method according to claim 4, wherein the substrate is vibrated by an acceleration of vibration of at least 1 G wherein G is gravitational constant.

* * * * *